United States Patent [19]

Tokita et al.

[11] Patent Number: 4,900,620

[45] Date of Patent: Feb. 13, 1990

[54] INK JET RECORDING SHEET

[75] Inventors: Makiko Tokita, Chiba; Masahiro Nakagawa, Hokkaido; Akira Kobayashi, Aichi; Kenji Yasuda, Chiba, all of Japan

[73] Assignee: OJI Paper Co., Ltd., Tokyo, Japan

[21] Appl. No.: 254,081

[22] Filed: Oct. 6, 1988

[30] Foreign Application Priority Data

Oct. 8, 1987 [JP] Japan ..... 62-254287

[51] Int. Cl.[4] ..... B41M 5/00

[52] U.S. Cl. ..... 428/330; 346/135.1; 428/195; 428/206; 428/207; 428/211; 428/342; 428/447; 428/500; 428/507; 428/514; 428/522; 428/537.1; 428/537.5

[58] Field of Search ..... 428/195, 207, 323, 330, 428/331, 211, 537.5, 206, 341, 342, 447, 500, 507, 514, 522, 537.1; 346/135.1

[56] References Cited

U.S. PATENT DOCUMENTS

| | | | |
|---|---|---|---|
| 4,335,184 | 6/1982 | Miyamoto et al. | 428/342 |
| 4,425,405 | 1/1984 | Murakami et al. | 428/342 |
| 4,474,847 | 10/1984 | Schioder | 428/323 |
| 4,478,910 | 10/1984 | Oshima et al. | 428/331 |
| 4,758,461 | 7/1988 | Caroc | 428/212 |

FOREIGN PATENT DOCUMENTS

| | | | |
|---|---|---|---|
| A2 0046416 | 2/1982 | European Pat. Off. | 428/195 |
| A2 0121916 | 10/1984 | European Pat. Off. | 428/195 |
| A2 0174859 | 3/1986 | European Pat. Off. | 428/195 |
| A1 0199874 | 11/1986 | European Pat. Off. | 428/195 |
| A1 0218956 | 4/1987 | European Pat. Off. | 428/195 |
| A 2028681 | 3/1980 | United Kingdom | 428/195 |
| A 2129333 | 5/1984 | United Kingdom | 428/195 |
| A 2166063 | 4/1986 | United Kingdom | 428/195 |
| A 2187137 | 9/1987 | United Kingdom | 428/195 |

*Primary Examiner*—Bruce H. Hess

*Attorney, Agent, or Firm*—Wenderoth, Lind & Ponack

[57] ABSTRACT

An ink jet recording sheet includes a sheet-like substrate composed mainly of 70 to 100 wt % of wood pulp and 0 to 30 wt % of precipitated calcium carbonate and having a Stöckigt sizing degree of not less than 2 seconds and not more than 25 seconds when formed into a sheet having a basis weight of 64 g/m$^2$, and a coating layer composed mainly of white pigment, with the coating layer being formed on at least one side of the substrate at a weight of 1 to 10 g/m$^2$. This sheet has a high ink absorption rate and is able to develop bright colors and sharp images.

11 Claims, No Drawings

INK JET RECORDING SHEET

BACKGROUND OF THE INVENTION

This invention relates to a coated type ink jet recording sheet. More particularly, it relates to a coated type ink jet recording sheet for use in an ink jet recording system that employs water-base ink, the sheet exhibiting a high rate of absorption of the ink deposited on the recording sheet so as to allow a clear color to develop, providing an image having circular dots and sharply defined edges, having a high surface strength and the same touch and feel during use as plain paper, and being able to record images with high resolution that are water-proof.

The ink jet recording sheet of the present invention may be used in recording, printing and writing employing water-base ink.

In order for an ink jet recording system to be able to produce high quality recorded images, it is required that the substrate employed be such that the ink deposited on the surface of the recording sheet which is composed mainly of paper spreads to form a true circle and is absorbed quickly in a controlled manner without becoming irregularly spread on the surface, and that the surface structure be such as to promote coloration of the deposited ink. Various proposals have so far put forward with a view to realizing these requirements.

For example, Japanese Patent Publication (KOKOKU) No. 27588/1985 discloses an ink jet recording paper wherein coating layer is applied with not less than 1 to 5 g/cm$^2$ of a binder to one surface of a substrate paper having a Stöckigt sizing degree of not more than 3 seconds such that ink droplets deposited on the paper surface are quickly absorbed within the interior of the sheet and spreading of the ink dots on the paper surface is prevented.

However, when the Stöckigt sizing degree of the substrate sheet is lowered for this purpose, the water-proof quality of the deposited ink will be inadequate and such phenomena as strike-through, irregular ink spreading and inferior coloring will occur. In order that the capacity to absorb ink may be improved to provide a higher ink absorption rate and that spreading of the ink may be controlled so as to realize a dot shape close to a true circle without adversely affecting the water-proof quality and the color brightness, it is necessary to drastically increase the amount of coating material coated on the substrate surface to a value not less than 10 g/m$^2$. With a coating amount of not more than 10 g/m$^2$, the dot shape and coloration are not satisfactory and the dot size control that is necessary for good quality image reproduction cannot be achieved. However, if the coating amount is increased, the cost is raised and the feel of the plain paper and its suitability for use and converting.

Non-coated type ink jet paper has recently become popular in view of its suitability from the standpoint of cost, printing quality and adaptability to use as office paper. It is known in regard to the production of such ink jet paper for liquid-absorbing pigments such as silica or heavy calcium carbonate to be added to the raw materials at the time of making the paper. However, this type of ink jet paper presents certain problems in that the ink may not develop sufficient color brightness when applied to and absorbed by the paper on account of certain optical properties of the pulp and filler customarily used so that clear coloration of a quality comparable to that obtained when using coated paper is not attainable. Furthermore spreading of the ink cannot be prevented and the ink absorption rate and capacity are low.

For applications in which importance is attached to the brightness of color images, a coated type of paper is employed which has a coating layer consisting essentially of white pigments having superior water absorption properties so that the above-described dot shape and color brightness can be obtained.

In the absence of a specialized type of processing, it is impossible to provide water-proof images if water-base ink is used with any of these types of paper. For this reason, it is necessary to perform a water-proofing operation using a cationic surfactant or cationic polymer.

However, the conventional water-proofing agents used for ink jet images, such as polyethyleneimine and copolymers thereof (see, for example, Japanese Patent Publication Nos. 120486/1982 and 129778/1982), have only poor water-proofing ability and tend to lower the weatherability qualities of the images formed. The provision of a coating of a water-soluble polymer is disclosed in Japanese Patent Publication (KOKAI) No. 8685/1983, while Japanese Patent Publication (KOKAI) No. 55283/1983 discloses use of polyvinylpyrrolidone and hydroxyethyl cellulose. However, it has been pointed out that the dot shape attainable in these cases is poor and the surface strength inadequate, the weatherability properties also being adversely affected. Japanese Patent Application (KOKAI) Nos. 20696/1984, 109894/1985 and 74880/1986 discloses the use of water-soluble metal salts or cationic polymers, such as polydiallyl dimethyl ammonium chloride. This approach is not satisfactory either, however, in that the degree of water-proofing is insufficient and the weatherability properties and, above all, the color fastness, are adversely affected.

It is thus an object of the present invention to provide a coated type sheet for ink jet recording in an ink jet recording system employing a water-base ink which not only allows the water-base ink to be absorbed quickly within the surface region of the recording sheet, but also provides for good ink image color brightness, the formation of ink dots which are truely circular in shape and the diffusion of which is inhibited, and the formation of sharp-tone images and allowing the production of high-resolution images at high speeds, thereby overcoming the deficiencies of the coated or filled type sheets of the prior art.

It is another object of the present invention to overcome the deficiencies of the water-proofing agent used in the aforementioned prior art and to provide a coated type ink jet recording sheet that offers superior image quality and water-proofness.

The recording sheet of the present invention may be used in the same way as other types of recording sheet with water-base ink employing pen plotters or the like.

SUMMARY OF THE INVENTION

According to the present invention, there is provided an ink jet recording sheet comprising a sheet-like substrate composed mainly of 70 to 100 wt% of wood pulp and 0 to 30 wt% of precipitated calcium carbonate and having a Stöckigt sizing degree of not less than 2 seconds and not more than 25 seconds when formed in a sheet having a basis weight of 64 g/m$^2$, and a coating layer composed mainly of white pigment, said coating layer being formed on at least one side of substrate at a weight of 1 to 10 g/m$^2$.

DETAILED DESCRIPTION OF THE INVENTION

Our studies have demonstrated that, in order to achieve a more balanced capacity to exhibit high-speed absorptivity and color brightness with the above described coated type of ink jet recording sheet, it is important to use in combination a substrate sheet having a predetermined compositional range and a coating layer formed from specific materials.

According to the present invention, the substrate consists essentially of 70 to 100 wt% of wood pulp and 0 to 30 wt% of precipitated calcium carbonate.

The wood pulp employed in the present invention is preferably bleached pulp obtained by bleaching the pulp that is produced when digesting natural wood. The precipitated calcium carbonate to be added to the wood pulp consists essentially of either calcite having a mean particle size ranging from 1 to 5 μm, a specific surface area ranging from 1 to 10 m$^2$/g, and oil absorption ranging from 30 to 50 ml/100 g, or of calcite not less than 80% of the particles of which have a particle size as measured by the natural precipitation method ranging between 0.5 and 1.5 μm, with a specific surface area of 10 to 30 m$^2$/g and oil absorption of 30 to 80 g/100 g.

The wood pulp and the precipitated calcium carbonate are formed into paper in a ratio of 70 to 100 wt% wood pulp to 0 to 30 wt% precipitated calcium carbonate. This compositional ratio is adapted in order to maximize the effects derived from addition of calcium carbonate and to ensure uniform ink absorption. If the content of wood pulp is lower than 70%, the properties of the paper sheets such as sheet strength will be impaired. If the content of precipitated calcium carbonate is more than 30%, the inclusion of the additional precipitated calcium carbonate would not lead to any further improvement. In addition, the surface strength of the sheet and the color concentration would be lowered, the natural feel of the paper would be lost, and paper dust would be generated to cause a lowering of the paper quality.

A sheet that is devoid of precipitated calcium carbonate, that is, consisting of 100 wt% of wood pulp, may also be employed as an ink jet recording sheet. However, a precipitated calcium carbonate content of 10 to 25 wt% provides the most desirable results and hence is most suitable.

It is noted that synthetic pulp and synthetic fibers having a high degree of whiteness may also included if used in a minor amount of not more than about 10%. The same may be said of precipitated calcium carbonate. It is thus possible to add about 10% of other white pigments, such as ground calcium carbonate, natural or synthetic zeolex, Kaolin clay, talc, diatomaceous earth, aluminium hydroxide, titanium dioxide or plastic pigment, depending upon the properties required such as paper quality and the overall cost.

It is also possible to use various additives commonly used in paper making, such as a dry-strength resins agent, retention aid, wet strength resins and dyestuffs. The sheet preferably has a thickness ranging between 20 and 200 μm, more preferably between 50 and 150 μm, and a basis weight ranging between 20 and 180 g/m$^2$, more preferably between 50 and 100 g/m$^2$.

It is essential that the Stöckigt sizing degree of the substrate sheet having a basis weight of 64 g/m$^2$ is 2 to 25 seconds. With a Stöckigt sizing degree lower than 2 seconds, not only are the water-proofing properties lowered, but also print through will take place and a tendency for irregular spreading of the ink may result. In order to provide ink absorptivity with a high ink absorption capacity and rate and to control the spreading of ink so that the formation of ink dots close in shape and that of a true circle can be realized, it is necessary to drastically increase the volume of coating on the substrate sheet surface. However, a coating weight of not more than 10 g/m$^2$ leads poor quality in terms of both dot shape and coloration, and additionally the dot size tends to become more difficult to control. On the other hand, with a Stöckigt sizing degree (basis weight: 64 g/m$^2$) of not less than 25 seconds, it is frequently difficult to provide ink absorptivity at a high ink absorption capacity and rate and to control the extent to which ink spreads so as to realize an ink dot shape that is close to a true circle unless the coating weight is increased to at least 10 g/m$^2$. It is therefore essential in the present invention for the Stöckigt sizing degree of the sheet having a basis weight of 64 g/m$^2$ to be in the range of from 2 to 25 seconds.

The coating layer consisting essentially of white pigment is applied to one or both sides of the sheet-like substrate at a weight of 1 to 10 g/m$^2$, preferably 2 to 8 g/m$^2$. The coating weight is in the range of from 1 to 10 g/m$^2$. In the present invention, the Stöckigt sizing degree of the sheet having the basis weight of 64 g/m$^2$ is 2 to 25 seconds, and the coating weight may thus be in the range of from 1 to 25 g/m$^2$. However, in order to provide adequate surface strength and a satisfactory appearance and at the same time to keep costs low, suitable results can be achieved by setting the coating weight to be no more than 10 g/m$^2$ in order to produce a highly adaptable sheet.

A bright white color pigment having high oil-absorption and a high specific surface area is preferred as the white pigment to be employed in the coating layer of the present invention. Above all, such preferred pigment should be composed of fine particles of silica having a specific surface area in the range of from 200 to 400 m$^2$/g and mainly composed of particles having a secondary particle size in the range of from 2 to 10 microns. Other white pigments may also be employed, depending on the particular application. Examples of such white color pigments include the pigments commonly used in coated paper sheets, such as precipitated and ground calcium carbonates, natural or synthetic zeolex, Kaolin clay, aluminium hydroxide, titanium dioxide and plastic pigments. These white pigments are preferably employed in an amount of not more than 50%.

The white pigments are usually contained in an amount consisting of 50 to 80 wt% of the coating layer.

A water-soluble polymer is preferably used to provide at least a portion of the adhesive properties of the coating layer. Also, a cationic polymer is preferably used as the image water-proofing agent.

In addition, a silanolated vinylalcohol polymer and/or a cationic vinylacetate copolymer may also be contained in the coating layer for good results.

Silanolated vinylalcohol copolymers exhibit excellent film-forming properties and a coating containing the same is transparent and tough and acts as a superior barrier, and the thick aqueous solution exhibits sol-gel thixotropy, depending or the pH and the temperature, and also exhibits superior adhesion to glass and alumina.

The copolymer to be employed preferably has a polymerization degree of 1,700 and a low silicate content. Any other silanolated vinylalcohol copolymer, such as that having a polymerization degree of 500 to 1,500 and a high silicate content may be employed in accordance with the intended usage. The silanolated vinylalcohol copolymer is preferably contained in an amount of 10 to 40 wt% of the coating layer since then the adhesive power and the adsorptivity are counterbalanced with respect to each other.

The cationic vinylacetate copolymer emulsion is a polyvinylacetate emulsion with cationicity that may be imparted in various ways. This cationic vinylacetate copolymer emulsion is preferably contained in an amount of 10 to 40 wt% of the coating layer to achieve the ink absorptivity and the adhesive power.

The water-soluble cationic polymer is preferably added to the coating layer also for the purpose of waterproofing the image. To this end, transparent aqueous solution of an acrylamide-dimethyl diallyl ammonium chloride copolymer, having a mean molecular weight of approximately 140,000 to 160,000 and a pH of 2 to 9, is most preferred. However, other water-soluble cationic polymers, such as polyethyleneimine and copolymers thereof, may also be employed.

Acrylamide-dimethyl diallyl ammonium chloride copolymer, which may be employed as the waterproofing agent in accordance with the present invention, is a copolymer having the following structural formula:

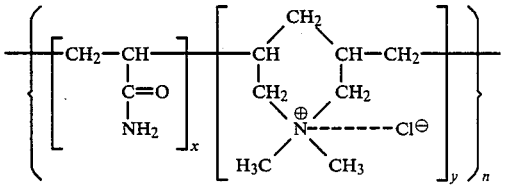

wherein x is 0.5 to 0.05, y is 0.5 to 0.95 and n is 20 to 2,000. Preferably, y is in the range of from 0.7 to 0.9 and n is in the range of from 100 to 200. This polymer may be obtained by polymerizing an acrylic acid amide

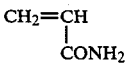

and a dimethyl diallyl ammonium chloride having the formula:

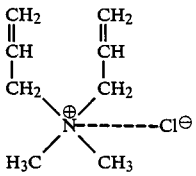

using light or using a radical polymerization catalyst. This polymer is generally a transparent liquid having a mean polymerization degree of about 140,000 to 160,000 and has a specific gravity of 1.00 to 1.10, a pH of 2 to 9 and an intrinsic viscosity size at 30° C., N/10 NaCl in the range of 1.60 to 2.00.

The amount of copolymer contained in the coating layer is preferably in the range from 3 to 30%, more preferably in the range from 5 to 11%.

It is to be noted that the sheet is preferably smoothed by a machine calendar or super calendar to a Bekk smoothness of not less than 50 seconds, since a sheet having good surface smoothness is required in ink jet printers.

The water-base ink recording sheet of the present invention is capable of imparting water-proofness to the image formed by the aqueous ink and is superior in regard to both ink absorptivity and dot shape when the ink is used in an ink jet printer, so that a full-color ink jet printer having high image resolution and free from the deficiencies of the prior art may be provided by using the ink of the present invention.

EXAMPLE 1

Calcite in the form of hexagonal prisms (precipitated calcium carbonate, with not less than 80% of the particles having a particle size in the range of from 0.5 to 1.5μ; a specific surface area of 80 ml/100 g; oil absorption of 80 ml/100 g (Albafil produced by Pfiser Corporation) was used as the filler. Fifteen parts of this filler was added to 100 parts of bleached hardwood kraft pulp (brightness, 91%) with water added thereto and the mixture was subjected to high speed dispersion and mixing followed by beating. Additives comprising 1 part cationic starch, 0.05 parts of a neutral sizing agent (Fibran 81, produced by Oji National Co.), 0.5 parts of urea formalin resin and 0.002 parts of Methyl Violet Blue were added. The resulting mixture was diluted with water to produce a paper-making material having a concentration of 0.03%.

Using a multi-cylinder Fourdrinier paper machine, the material was formed into high quality paper having a basis weight of 64 g/m$^2$ to produce a substrate for ink jet recording having a brightness of 92%, an ash content of 11.4% and a Stöckigt sizing degree of 15 seconds. A layer of Coating 1 (see below) was formed on the substrate at a weight of 2 g/m$^2$, and was then dried and smoothed by a super-calendar to produce an ink jet recording sheet. The Bekk smoothness was 110 seconds.

| | |
|---|---|
| Pigment: | Fine silica particles (Finesil produced by the Tokuyama Soda Co., Ltd.) - 100 parts; |
| Binder: | Polyvinylalcohol (PVA-105, produced by Kuraray) - 50 parts: |
| Cationic Polymer: | Polyethyleneimine quaternary ammonium salts - 20 parts; |
| Dispersant: | Sodium polyacrylate - 1 part |

EXAMPLE 2

Following the same procedure as that taken in Example 1 and using the same paper-making material except for using star-shaped calcite as the precipitated calcium carbonate, a substrate having a basis weight of 64 g/m$^2$ and a Stöckigt sizing degree of 8 seconds was produced. Coating 1 was applied to the substrate at a weight of 5 g/m$^2$, in the same way as in Example 1, and was dried and smoothed by a super calendar to produce an ink jet recording sheet having a coating layer. The Bekk smoothness was 110 seconds.

EXAMPLE 3

A high quality paper sheet having a basis weight of 65 g/m$^2$, brightness of 92% and a Stöckigt sizing degree of 15 seconds and containing calcite-type precipitated calcium carbonate (Albaglos, Pfizer Inc.) as a filler was used as the substrate paper.

Coating 2 (see below) was applied on this substrate paper at a weight of 2 g/m$^2$, and then dried and smoothed by a calendering machine to produce a coated ink jet recording paper sheet without any pigment. The Bekk smoothness was 55 seconds.

| Coating 2 |
|---|
| Polyvinylalcohol (PVA-217, produced by Kuraray Co.) - 100 parts of a copolymer of 50 mol % of acrylamide and 50 mol % of diallyl dimethyl ammonium chloride (PAS-J-11, produced by Nittobo Co.) - 20 parts |

EXAMPLE 4

Calcite based precipitated calcium carbonate having a mean particle size ranging from 1 to 5 microns, a specific surface area ranging from 1 to 10 g/m$^2$ and oil absorption 30 to 50 ml/100 g (produced by Shiraishi Kogyo Co.) was added as a filler to 100 parts of bleached hardwood kraft pulp (brightness, 91%). To the resulting mixture were added 1 part of cationic starch, 0.05 parts of a neutral sizing agent (Fibran 81, produced by Oji National Co.), 0.5 parts of a urea formalin resin and 0.002 parts of Methye Violet Blue, and the resulting mass was formed into a high quality paper sheet having a basis weight of 64 g/m$^2$, using a multi-cylinder Fourdrinier paper machine in the conventional manner to produce a substrate 1 having a whiteness degree of 92%, an ash content of 15.0% in the form of calcium carbonate and a Stöckigt sizing degree of 5 seconds. Coating 3 (see below) was applied to the substrate at a weight of 5 g/m$^2$, and was dried and smoothed by a super calender to a Bekk smoothness degree of 110 seconds to produce an ink jet recording sheet.

| Coating 3 |
|---|
| Fine particles of silica (Finesil, produced by Tokuyama Soda Co.) - 100 parts;<br>Polyvinylalcohol (PVA - 117, produced by Kuraray Co.) - 30 parts;<br>Dispersant: Sodium polyacrylate - 1 part |

EXAMPLE 5

Coating 4 was applied on the substrate of the preceding Example 4 at a weight of 5 g/m$^2$, and was dried and smoothed by a super calender to produce a coated ink jet recording sheet. The Bekk smoothness degree was 110 seconds.

| Coating 4 |
|---|
| Fine particles of silica (Finesil, produced by Tokuyama Soda Co.) - 100 parts;<br>Vinylalcohol copolymer (R-1130, produced by Kuraray Co.) - 20 parts;<br>Cationic vinylacetate copolymer (IE 501 K-4) - 30 parts;<br>Cationic water-soluble polymer (polyethyleneimine |

-continued

| Coating 4 |
|---|
| quaternary ammonium salt) - 20 parts;<br>Dispersant: Sodium polyacrylate - 1 part |

EXAMPLE 6

A substrate was formed using the same procedure as that employed in Example 4 and using the same paper-making material except that the calcite used as the precipitated calcium carbonate was such that not less than 80% of the particles ranged in size from 0.5 to 1.5 μm and the specific surface area thereof was 1 to 20 g/m$^2$ and the oil absorption 10 to 80 ml/100 g (Albafil, produced by Pfizer Inc.). In this way a substrate having a Stöckigt sizing degree of 10 seconds was obtained. Coating 5 was applied to this substrate at a weight of 5 g/m$^2$, and was dried and smoothed by a super calender to produce a coated ink jet recording sheet. The Bekk smoothness was 110 seconds.

| Coating 5 | |
|---|---|
| Pigment: | Fine particles of silica (Mizukasil, produced by Mizusawa Kagaku Co.) - 100 parts; |
| Binder: | Polyvinylalcohol copolymers (R-1130, produced by Kuraray Co. - 30 parts and PVA-217, produced by Kuraray Co. - 10 parts);<br>Cationic with vinylacetate copolymer (Yodozol, Kanebo NSC) - 30 parts;<br>Water-soluble cationic polymer (acrylamide - dimethyl diallyl ammonium chloride copolymer) - 20 parts; |
| Dispersant: | Sodium polyacrylate - 1 part |

COMPARATIVE EXAMPLE 1

Using the same material and procedure as in Example 1, except that 0.02 parts of a neutral sizing agent (Fibran 81, Oji National Co.) was added as the additive at the time of adding the filler to the ordinary bleached hardwood kraft pulp, which was subjected to high speed dispersion and mixing followed by beating, an ink jet recording substrate having a basis weight of 64 g/m$^2$ was produced. The substrate had a whiteness degree of 92%, an ash content of 11.6% and a Stöckigt sizing degree of not more than one second. Coating 1 was applied to this substrate at a weight of 2 g/m$^2$, and was dried and smoothed by a super calender to produce an ink jet recording sheet. The Bekk smoothness degree was 100 seconds.

COMPARATIVE EXAMPLE 2

Using the same method as in Comparative Example 1, except that 0.15 parts of the neutral sizing agent (Fibran 81, produced by Oji National Co.) was added, a substrate for ink jet recording having a basis weight of 64 g/m$^2$, a brightness of 92%, an ash content of 11.0% and a Stöckigt sizing degree of 30 seconds was produced. Coating 1 was applied to this substrate at a weight of 2 g/m$^2$, and was dried and smoothed by a super calender to produce a sheet for ink jet recording. The Bekk smoothness was 120 seconds.

COMPARATIVE EXAMPLE 3

Coating 6 was applied on the high quality paper of Example 3, which acted as the substrate paper, at a weight of 12 g/m$^2$, and was dried and smoothed by a super calender to produce a sheet for ink jet recording. The Bekk smoothness was 100 seconds.

| Coating 6 | |
|---|---|
| Pigment: | Fine particles of Silica (Finesil, produced by Tokuyama Soda Co.) - 100 parts; |
| Binder: | Polyvinylalcohol (R-2105 produced by Kuraray Co. - 10 parts and PVA-105 produced by Kuraray Co. - 50 parts); |
| Water-proofing agent: | Polyethyleneimine - 10 parts; |

COMPARATIVE EXAMPLE 4

Coating 7 was applied on the high quality paper of Example 3, and was dried and smoothed by a super calender to produce a sheet for ink jet recording. The Bekk smoothness was 100 seconds.

| Coating 7 | |
|---|---|
| Pigment: | Fine particles of silica (Fine Seal produced by Tokuyama Soda Co.) - 100 parts; |
| Binder: | Polyvinylalcohol (R-2105, produced by Kuraray Co. - 10 parts and PVA-105, produced by Kuraray Co. - 50 parts); |
| Water-proofing agent: | Dimethyl diallyl ammonium chloride (PAS-H-35S, produced by Nittobo Co.) - 10 parts |

COMPARATIVE EXAMPLE 5

Following the same procedure as in Example 4 except for using 0.20 parts of neutral sizing agent, a substrate having a basis weight of 64 g/m$^2$ and a Stöckigt sizing degree of 30 seconds was produced. Coating 4 was applied in the same way as in Example 4 at a weight of 5 g/m$^2$, and was dried and smoothed by a super calender to produce a coated ink jet recording sheet. The Bekk smoothness was 110 seconds.

The results of evaluation of the ink jet recording sheets for all these cases are shown in Table 1, wherein the symbols ◎, o, Δ and x indicate the quality in decreasing order. x stands for the worst case in which the sheets were found to be unusable.

TABLE 1

| No. | Coating amount (g/m$^2$) | Ink absorptivity | Color brightness | Dot shape | Water proofness | Surface strength |
|---|---|---|---|---|---|---|
| Ex. 1 | 2 | o | ◎ | ◎ | | ◎ |
| 2 | 5 | ◎ | o | o | | ◎ |
| 3 | 2 | o | o | Δ | ◎ | |
| 4 | 5 | o | o | o | | o |
| 5 | 5 | ◎ | o | ◎ | | ◎ |
| 6 | 5 | ◎ | ◎ | ◎ | | ◎ |
| Comp. Ex. 1 | 2 | Δ | X | Δ | | o |
| 2 | 2 | X | X | X | | o |
| 3 | 12 | Δ | Δ | Δ | Δ | |
| 4 | ↑ | o | o | Δ | o | |
| 5 | 5 | X | Δ | Δ | | o |

Method of Evaluation of Recording Properties

The ink jet recording properties of the above-described coatings were evaluated by practical use in a commercially available ink jet printer and with respect to ink absorptivity, color brightness and the shape of the recording dots formed.

In evaluating ink absorptivity, the time in seconds taken for ink smudging on the printed portion to dry was measured and compared.

In evaluating the dot shape, printed dots formed on the paper sheet being tested by an ink jet printer were measured and observed through a microscope. The marks ◎, o, Δ and x indicate how close to a true circle the observed dot shapes were in decreasing order of quality.

In evaluating water-proofness, the printed images were dipped in flowing water for five minutes and then dried. The marks ◎, o, Δ and x denote the degree to which the printed image disappeared, with the marks ◎ and x respectively indicating images which remain unchanged after drying and those which almost completely disappear.

What is claimed is:

1. An ink jet recording sheet comprising a substrate in the form of a sheet composed mainly of 70 to 100 wt% wood pulp and 10 to 25 wt% precipitated calcium carbonate selected from the group consisting of (1) a calcite having a particle size distribution such that not less than 80% of the particles as measured by the natural precipitation method range from 0.5 to 1.5·μm in size, a specific surface area ranging between 10 to 30 m$^2$/g and an oil absorption ranging between 30 and 80 ml/100 g; and (2) a calcite having a mean particle size ranging between 1 and 5 μm, a specific surface area ranging between 1 and 10 m$^2$/g and an oil absorption ranging between 30 and 50 ml/100 g, and having a Stöckigt sizing degree of not less than 5 seconds and not more that 15 seconds when formed as a sheet having a basis weight of 64 g/m$^2$, and a coating layer composed mainly of white pigment, said coating layer being formed on al least one side of said substrate at a weight of 1 to 10 g/m$^2$.

2. An ink jet recording sheet according to claim 1, wherein said precipitated calcium carbonate of the substrate is calcite having a particle size distribution such that not less than 80% of the particles as measured by the natural precipitation method range from 0.5 to 1.5 μm in size, a specific surface area ranging between 10 and 30 m$^2$/g and an oil absorption ranging between 30 and 80 ml/100 g.

3. An ink jet recording sheet according to claim 1 wherein the coating layer consisting essentially of white pigment is formed at a weight of 2 to 8 g/m$^2$.

4. An ink jet recording sheet according to claim 1 wherein the precipitated calcium carbonate of the substrate is calcite having a mean particle size ranging between 1 and 5 μm, a specific surface area ranging between 1 and 10 m$^2$/g and an oil absorption ranging between 30 and 50 m.100 g.

5. An ink jet recording sheet according to claim 1 wherein the white pigment of the coating layer is silica having a specific surface area ranging between 200 and 400 m$^2$/g and a secondary particle size ranging between 2 and 10 m, with the silica content being 50 to 80 wt%.

6. An ink jet recording sheet according to claim 1 wherein the coating layer contains 10 to 40 wt% of cationic vinylacetate copolymer.

7. An ink jet recording sheet according to claim 1 wherein the coating layer contains 10 to 40% of a silanolated vinylalcohol copolymer.

8. An ink jet recording sheet according to claim 1 wherein the substrate layer or the coating layer contains a water-soluble cationic polymer.

9. An ink jet recording sheet according to claim 8 wherein the water-soluble cationic polymer is a copolymer containing acrylamide and dimethyl diallyl ammonium chloride as the main monomeric units.

10. An ink jet recording sheet according to claim 1 wherein the coating layer contains a binder.

11. An ink jet recording sheet according to claim 10 wherein the binder is polyvinyl alcohol.

* * * * *